US008505608B2

(12) United States Patent
Sawada

(10) Patent No.: US 8,505,608 B2
(45) Date of Patent: Aug. 13, 2013

(54) REINFORCING STRUCTURE FOR SLIDE SHUTTER

(76) Inventor: Katsuya Sawada, Tottori (JP)

( * ) Notice: Subject to any disclaimer, the term of this patent is extended or adjusted under 35 U.S.C. 154(b) by 27 days.

(21) Appl. No.: 13/260,495

(22) PCT Filed: May 11, 2009

(86) PCT No.: PCT/JP2009/058755
§ 371 (c)(1),
(2), (4) Date: Sep. 26, 2011

(87) PCT Pub. No.: WO2010/131320
PCT Pub. Date: Nov. 18, 2010

(65) Prior Publication Data
US 2012/0024483 A1 Feb. 2, 2012

(51) Int. Cl.
*E06B 9/08* (2006.01)

(52) U.S. Cl.
USPC .. 160/133; 160/201; 160/290.1; 292/DIG. 36

(58) Field of Classification Search
USPC ..... 160/201, 133, 265, 290.1; 292/DIG. 36
See application file for complete search history.

(56) References Cited

U.S. PATENT DOCUMENTS

| | | | | |
|---|---|---|---|---|
| 1,591,739 | A * | 7/1926 | Blake | 160/274 |
| 1,954,825 | A * | 4/1934 | Morris | 160/191 |
| 2,993,572 | A * | 7/1961 | Rich | 160/229.1 |
| 2012/0024483 | A1 * | 2/2012 | Sawada | 160/202 |

FOREIGN PATENT DOCUMENTS

| | | | |
|---|---|---|---|
| JP | 2003307082 | A | 10/2003 |
| JP | 2006299522 | A | 11/2006 |

OTHER PUBLICATIONS

English version of International Search Report dated Jun. 9, 2009.

* cited by examiner

*Primary Examiner* — Blair M. Johnson
(74) *Attorney, Agent, or Firm* — McClure, Qualey & Rodack, LLP

(57) ABSTRACT

A reinforcing structure for a slide shutter deters unauthorized entry of an intruder into a building and allows easy opening and closing of the shutter. The reinforcing structure (1) for a slide shutter has a vertically movable shutter curtain (3) formed by interconnecting slats (3*a*), a left and right pair of guide rails (4*a*, 4*b*) for guiding the shutter curtain (3), and a shutter case (5) into which the shutter curtain (3) is wound and contained. The reinforcing structure (1) is also provided with a shutter reinforcing base member (6) having one end rotatably mounted to the upper end of one guide rail (4*a*) and the other end open, a length adjusting member (7) inserted in the shutter reinforcing base member (6), and a connecting member (8*a*) rotatably connected to the front end of the length adjusting member (7), vertically sliding while being guided by the other guide rail (4*b*), and capable of being removably mounted to the shutter curtain (3).

2 Claims, 10 Drawing Sheets

REINFORCING STRUCTURE FOR SLIDE SHUTTER

CROSS REFERENCE TO RELATED APPLICATION

This application is the 35 U.S.C. §371 national stage of PCT application PCT/JP2009/058755, filed May 11, 2009, the disclosure of which is hereby incorporated by reference.

TECHNICAL FIELD

The present invention relates to a reinforcing structure for a slide shutter, and more particularly, to a reinforcing structure for a slide shutter capable of interlocking with up-and-down movement of a shutter curtain of the slide shutter.

BACKGROUND ART

A slide shutter provided at an opening such as a window and a door of a building includes a shutter curtain which is guided by a pair of guide rails provided on both sides of the opening of the building and which opens and closes the opening in the vertical direction. The slide shutter usually includes a shutter case at an upper portion of the opening of the building for rolling up and accommodating the shutter curtain therein. In the case of such a slide shutter, if strong wind blows due to bad weather such as a typhoon and a hurricane, the shutter curtain is pushed toward a room interior by wind pressure and is largely bent, and slats which configure the shutter curtain fall out from the guide rails or are damaged in some cases.

In order to solve such a problem of a slide shutter 100, as shown in FIG. 10 for example, there are proposed various reinforcing structures 105 for a slide shutter in which a rod-like reinforcing body 101 is brought into contact, under pressure, with slats 103 which configure a shutter curtain 102, and both ends of the reinforcing body 101 are fixed to guide rails 104 (for example, patent documents 1 and 2).

With such a reinforcing structure, it is possible to restrain the shutter curtain 102 from bending even when strong wind blows, and to prevent the shutter curtain 102 from falling out or being damaged.

According to the slide shutter 100, it is also possible to artificially disengage the slats 103 from the guide rails 104 using a tool such as a bar. There is a fear of unauthorized invasion into a building from between the guide rails 104 and the shutter curtain 102. If the reinforcing structure 105 for the slide shutter is attached, since it becomes difficult to detach the slats 103, it has efficacy for preventing the unauthorized invasion.

[Patent Document 1] Japanese Unexamined Patent Publication No. 2007-315022

[Patent Document 2] Japanese Unexamined Patent Publication No. 2007-23701

DISCLOSURE OF THE INVENTION

Problems to be Solved by the Invention

Even if the reinforcing structure is used, it is possible to prevent some of the slats 103 configuring the shutter curtain 102 near the reinforcing body 101 from being detached from the guide rails 104, but it is not possible to prevent other slats 103 located away from the reinforcing body 101 from being detached from the guide rails 104. Therefore, there is fear that slats 103 near a key of the slide shutter 100 are detached from the guide rails 104, the key is opened from inside of the building and someone illegally invades.

According to the reinforcing structure, since the reinforcing body 101 is attached or detached whenever the slide shutter 100 is opened or closed, the operation is troublesome and a user may forget to attach the reinforcing body 101 when the slide shutter 100 is closed.

Hence, it is an object of the present invention to provide a reinforcing structure for a slide shutter capable of suppressing unauthorized invasion into a building and capable of easily opening and closing the shutter.

Means for Solving the Problems

To achieve the above object, a reinforcing structure for a slide shutter of the present application is characterized in that the slide shutter includes a shutter curtain which is formed by connecting a plurality of vertically moving slats with each other, a pair of left and right guide rails for guiding the shutter curtain, and a shutter case which is provided above the guide rails and which rolls up the shutter curtain and accommodates the shutter curtain therein, wherein the reinforcing structure includes a hollow long shutter reinforcing base material whose one end is rotatably mounted on an upper end of one of the pair of guide rails and whose other end is opened, a length-adjusting member which is inserted into the shutter reinforcing base material and which can extend and contract, a connecting member which is rotatably connected to a tip end of the length-adjusting member and which is guided by the other one of the pair of guide rails, and a reversed L-shaped hook which is formed on a surface of the connecting member on a side of the shutter curtain and which is inserted, from above, into an annular engaging portion formed on one of the slats that is located on a lowermost side, and wherein the connecting member includes a fixing tool which can be fixed to a fixing hole formed in a installation surface of the slide shutter and which can be engaged with an engaging hole formed in the shutter case.

A reinforcing structure for a slide shutter of another embodiment of the present application is characterized in that the slide shutter includes a shutter curtain which is formed by connecting a plurality of vertically moving slats with each other, a pair of left and right guide rails for guiding the shutter curtain, and a shutter case which is provided above the guide rails and which rolls up the shutter curtain and accommodates the shutter curtain therein, wherein the reinforcing structure includes a hollow long first reinforcing base material whose one end is rotatably mounted on an upper end of one of the pair of guide rails and whose other end is opened, a long first length-adjusting member which is inserted into the first reinforcing base material and which can extend from the first reinforcing base material and which can contract, a hollow and long second reinforcing base material whose one end is rotatably mounted on an upper end of the other guide rail and whose other end is opened, a long second length-adjusting member which is inserted into the second reinforcing base material and which can extend from the second reinforcing base material and which can contract, and a connecting member which rotatably connects a tip end of the first length-adjusting member and a tip end of the second length-adjusting member with each other and which is attachable to and detachable from a lower end of the slat, and wherein the connecting member includes a fixing tool which can be fixed to a fixing hole formed in a installation surface of the slide shutter and which can be engaged with an engaging hole formed in the shutter case.

Effect of the Invention

According to the reinforcing structure for the slide shutter of the present invention, the reinforcing structure includes a hollow long reinforcing base member whose one end is rotatably mounted on an upper end of one of the pair of left and right guide rails and whose other end is opened, a length-adjusting member which is inserted into the reinforcing base member and which can extend and contract, and a connecting member which is rotatably connected to a tip end of the length-adjusting member and which is attachable to and detachable from a lower end of the shutter curtain which is guided by the other guide rail and slides vertically. Therefore, when the shutter curtain is pulled down to close the slide shutter, while keeping the one end of the reinforcing base member mounted on the upper end of the one of the guide rails, the connecting member interlocks with the lowering movement of the shutter curtain and slides downward along the guide rails. Therefore, the reinforcing base member and the length-adjusting member diagonally extend from the upper end of the one guide rail to the lower end of the other guide rail and thus, it is possible to reinforce the shutter curtain which is disposed between both the guide rails.

When the shutter curtain is pulled up to open the slide shutter, the connecting member interlocks with the rising movement of the shutter curtain and slides upward along the guide rails. Therefore, since the reinforcing base member and the length-adjusting member extend between upper ends of both the guide rails, the slide shutter can be opened without closing the building opening. According to the reinforcing structure for the slide shutter of the present invention, it is possible to reliably reinforce the shutter curtain when the slide shutter is closed, and to open and close the slide shutter by the same operation as the opening and closing operations of the conventional slide shutter.

According to a reinforcing structure for a slide shutter of another embodiment, the reinforcing structure includes a hollow long first reinforcing base member whose one end is rotatably mounted on an upper end of one of the pair of guide rails and whose other end is opened, a long first length-adjusting member which is inserted into the first reinforcing base member and which can extend and contract from the first reinforcing base member, a hollow and long second reinforcing base member whose one end is rotatably mounted on an upper end of the other guide rail of the pair of guide rails and whose other end is opened, a long second length-adjusting member which is inserted into the second reinforcing base member and which can extend and contract from the second reinforcing base member, and a connecting member which rotatably connects a tip end of the first length-adjusting member and a tip end of the second length-adjusting member with each other and which is attachable to and detachable from a lower end of the slat. Therefore, like the reinforcing structure for the slide shutter of claim 1, it is possible to open and close the slide shutter by the same operation as the opening and closing operations of the conventional slide shutter. Especially according to the reinforcing structure for the slide shutter of claim 2, the first reinforcing base member and the first length-adjusting member, and the second reinforcing base member and the second length-adjusting member are disposed in substantially V-shape when the slide shutter is closed, it is possible to reinforce the shutter curtain more strongly and thus, this reinforcing structure can preferably be used for a wide slide shutter in which an intermediate position of the shutter curtain in its width direction is prone to be bent.

According to the reinforcing structure for the slide shutter, since the connecting member includes a fixing tool which can be fixed to a fixing hole formed in an installation surface of the slide shutter, it is possible to lock the shutter curtain by fixing the fixing tool to the fixing hole in a state where the slide shutter is closed. Therefore, it is possible to suppress the unauthorized invasion into the building where the slide shutter is disposed. Since the connecting member is fixed to the installation surface of the slide shutter and is also engaged with a lower end of the shutter curtain, it is possible to more effectively restrain the shutter curtain from being bent.

According to the reinforcing structure for the slide shutter, since the fixing tool can be engaged with an engaging hole formed in the shutter case, it is possible to pull down the shutter curtain while keeping the connecting member fixed to the upper location. As a result, the reinforcing base member and the length-adjusting member are maintained in a state where they extend between the upper ends of both the guide rails, and they do not interlock with the opening and closing operation of the slide shutter. Therefore, it is possible to reduce a load applied when the slide shutter is opened and closed.

DESCRIPTION OF REFERENCE SIGNS

Figure 1:
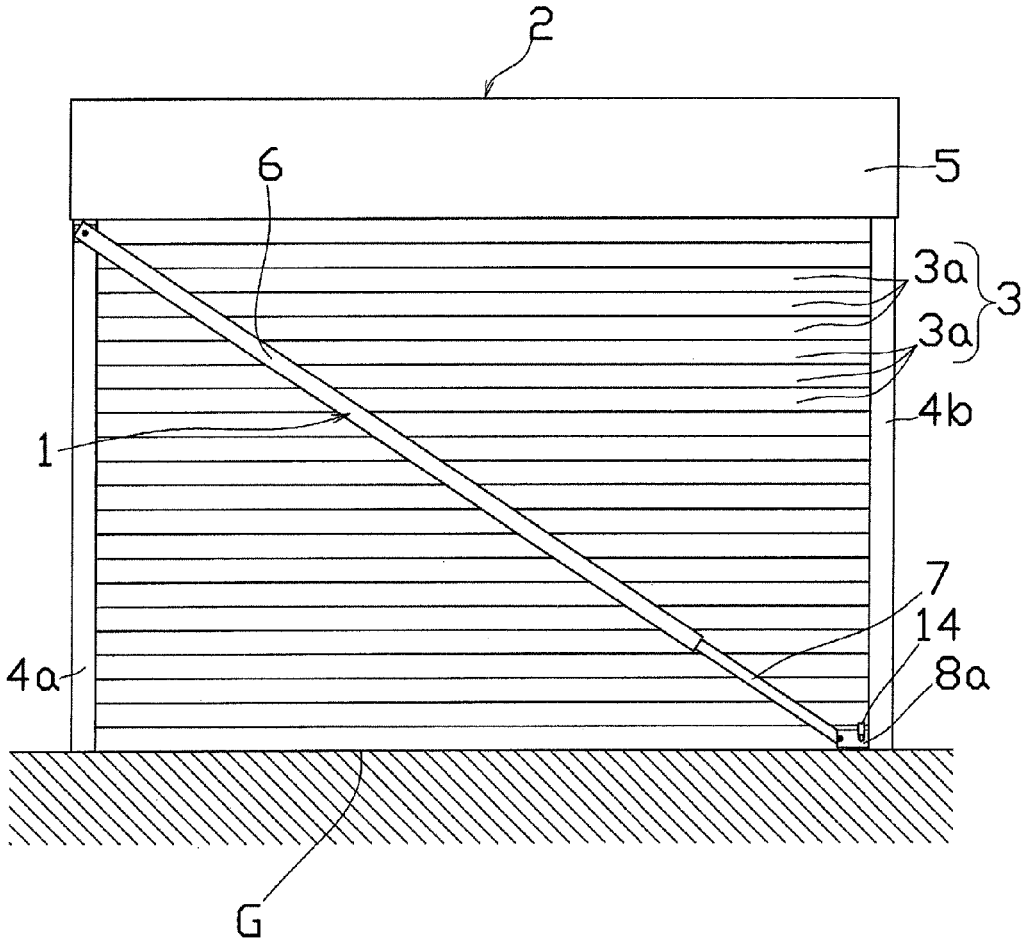
FIG. 1 is a front view showing a reinforcing structure for a slide shutter according to a first embodiment.

1: reinforcing structure for slide shutter
2: slide shutter
3: shutter curtain
3*a*: slat
4*a*, 4*b*, 4*c*, 4*d*: guide rails
5: shutter case
6: reinforcing base member
6*a*: first reinforcing base member
6*b*: second reinforcing base member
7: length-adjusting member
7*a*: first length-adjusting member
7*b*: second length-adjusting member
8*a*, 8*b*: connecting member
15: fixing tool
16: fixing hole
G: installation surface

BEST MODE FOR CARRYING OUT THE INVENTION

A first embodiment for carrying out the present invention will be described below with reference to the drawings. As shown in FIG. 1, a reinforcing structure 1 for a slide shutter of the embodiment includes a slide shutter 2. The slide shutter 2 has a shutter curtain 3 formed by interconnecting a plurality of slats 3*a*, a pair of left and right guide rails 4*a* and 4*b* for vertically guiding the shutter curtain 3, and a shutter case 5 which rolls up the shutter curtain 3 at an upper location and accommodates the shutter curtain 3 therein. The reinforcing structure 1 also includes a hollow long reinforcing base member 6, one end of the reinforcing base member 6 is turnably mounted on an upper end of the guide rail 4*a* and the other end of the reinforcing base member 6 is opened. The reinforcing structure 1 also includes a length-adjusting member 7 inserted into the reinforcing base member 6 such that the length-adjusting member 7 can extend and contract, and a connecting member 8*a* which is rotatably mounted on a tip end of the length-adjusting member 7, and which slides vertically while being guided by the other guide rail 4*b*.

Figure 2:
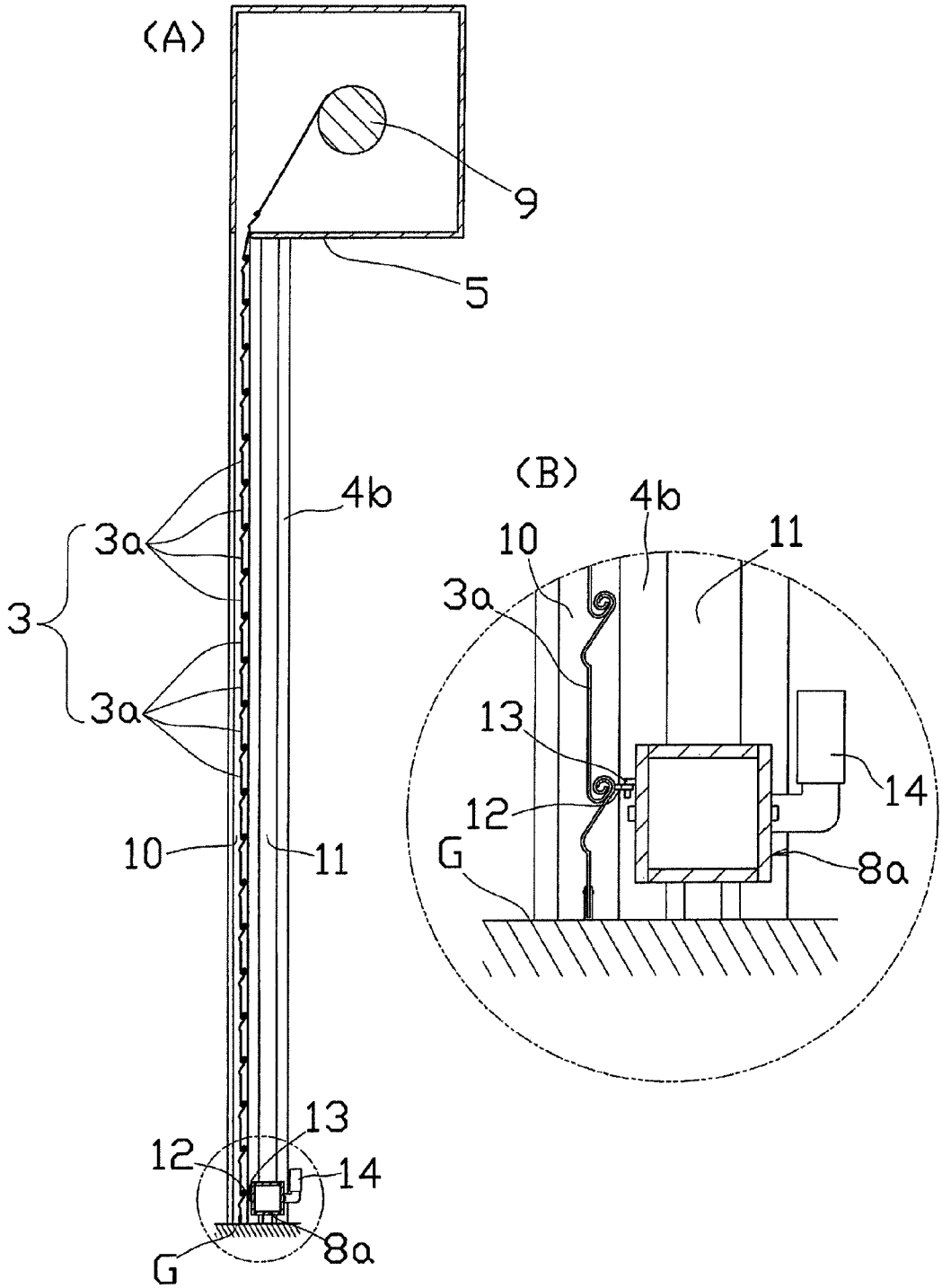
FIG. 2(A) is a sectional view showing the reinforcing structure for the slide shutter of the first embodiment and FIG. 2(B) is an enlarged sectional view of a portion surrounded by a phantom line in FIG. 2(A).

As shown in FIG. 2(A), an upper end of the shutter curtain 3 is connected to a roll-up shaft 9 which is accommodated in the shutter case 5, and the shutter curtain 3 is rolled up into the shutter case 5 and accommodated therein by rotation of the roll-up shaft 9. In this embodiment, when a building opening is to be opened, the roll-up shaft 9 is rotated using a resilient body such as a spring, thereby rolling up the slats 3*a*, and when the building opening is to be closed, an operator pulls down the shutter curtain 3 by human power using a pull-down rod (not shown) provided at its tip end with a hook, but the embodiment of the present invention is not limited to this configuration, and the shutter curtain 3 may be moved up and down by rotating the roll-up shaft 9 using power such as electric power.

Figure 3:
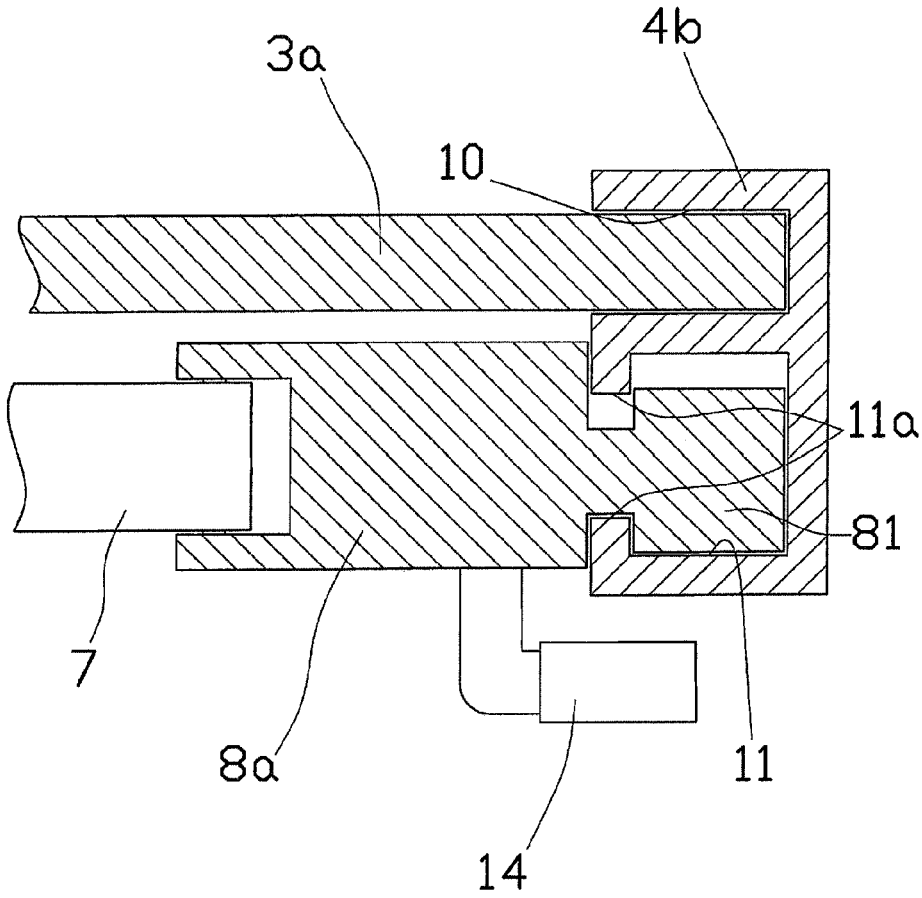
FIG. 3 is a partial enlarged sectional view of cross sections of guide rails and a connecting member as viewed from above.

As shown in FIG. 2(B), an annular engaging portion 12 into which a reversed L-shaped hook 13 formed on the connecting member 8*a* can be inserted is provided on the lowermost slat 3*a* of the shutter curtain 3. As shown in FIG. 3, of the pair of guide rails 4*a* and 4*b*, the guide rail 4*b* along which the connecting member 8*a* is guided has a substantially E-shaped cross section. The guide rail 4*b* includes a first rail groove 10 for vertically guiding the shutter curtain 3, and a second rail groove 11 for guiding the connecting member 8*a*. An opening edge 11*a* of the second rail groove 11 slightly projects inward, the second rail groove 11 is fitted into grooves formed in both side surfaces of the connecting member 8*a* and the second rail groove 11 prevents a tip end 81 of the connecting member 8*a* from falling out from the second rail groove 11. The guide rail 4*a* located on the opposite side has a U-shaped cross section having the first rail groove 10 for vertically guiding the shutter curtain 3.

The reinforcing base member 6 is a cylindrical member which is slightly shorter than a lateral width of the slide shutter 2. The reinforcing base member 6 can be made of various materials such as metal, wood and resin capable of securing strength for reinforcing the shutter curtain 3, but if light-weighted and strong resin such as fiber reinforced plastic using carbon fiber or glass fiber is used, it is possible to realize the reinforcing structure 1 for the slide shutter capable of moving the shutter curtain 3 up and down with a small force while securing reinforcing strength for the shutter curtain 3. A resilient body (not shown) such as an elastomer is pasted on a surface of the reinforcing base member 6 that abuts against the shutter curtain 3 so that the reinforcing base member 6 can easily come into intimate contact with the shutter curtain 3. Even when the shutter curtain 3 collides against the reinforcing base member 6, the shutter curtain 3 and the reinforcing base member 6 are not damaged, and a noise caused by the collision can effectively be suppressed. One end of the reinforcing base member 6 is rotatably mounted on an upper end of the guide rail 4*a* along which the connecting member 8*a* is not guided. The other end of the reinforcing base member 6 opens, and a portion of the length-adjusting member 7 can be accommodated in its internal space.

The length-adjusting member 7 can be made of various materials such as metal, wood and resin like the reinforcing base member 6, and light-weighted and strong synthetic resin is especially preferable. The length-adjusting member 7 has such a thickness that it can be inserted into the reinforcing base member 6, and a tip end of the length-adjusting member 7 is rotatably supported by the connecting member 8*a*.

As shown in FIG. 3, one side of the connecting member 8*a* is inserted into the second rail groove 11 of the guide rail 4*b* and can slide therein, and the other side of the connecting member 8*a* rotatably supports the tip end of the length-adjusting member 7. As shown in FIG. 2*b*, the reversed L-shaped hook 13 which is inserted, from above, into the engaging portion 12 provided on the lowermost slat 3*a* is provided on the connecting member 8*a* on the side of the shutter curtain 3. An operating lever 14 that can be rotated by an operator is mounted on a surface of the connecting member 8*a* which is opposite from the shutter curtain 3. By rotating the operating lever 14, an anchor-shaped fixing tool 15 can projects from upper and lower surfaces of the connecting member 8*a*.

Figure 4:
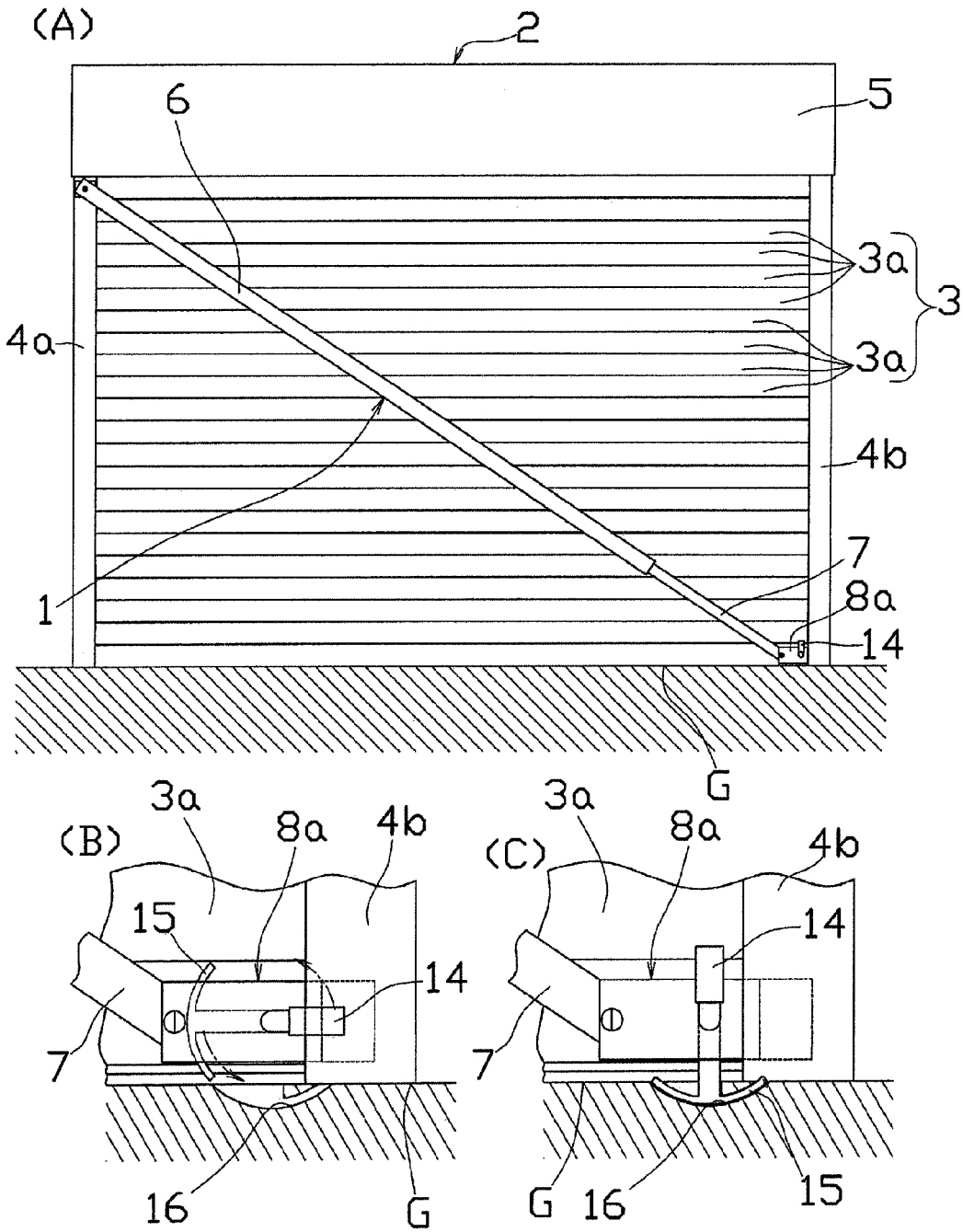
FIG. 4(A) is a front view for explaining a closed state of the slide shutter.
FIG. 4(B) is a partial enlarged sectional view of a state before a fixing tool is inserted into a fixing hole as viewed from front and FIG. 4(C) is a partial enlarged sectional view of a state after the fixing tool is inserted into the fixing hole as viewed from front.

The up-and-down operation of the slide shutter 2 using the reinforcing structure 1 for the slide shutter having the above-described configuration will be described. According to the reinforcing structure 1 for the slide shutter of this embodiment, as shown in FIG. 4(A), the connecting member 8*a* which is engaged with the lowermost slat 3*a* of the shutter curtain 3 is pulled down to lower ends of the guide rails 4*a* and 4*b* by pulling the shutter curtain 3 down to a lower end of the building opening. Then, as shown in FIGS. 4(B), 4(B) and 5, the operating lever 14 is operated and the fixing tool 15 of the connecting member 8*a* is inserted into and fixed to a fixing hole 16 formed in an installation surface G of the slide shutter 2.

The fixing hole 16 formed in the installation surface G of the slide shutter 2 has such a shape that a portion of the anchor-shaped fixing tool 15 can be inserted into and fixed to the fixing hole 16, and a surface 16*b* of the fixing hole 16 which is opposite from the shutter curtain 3 inclines toward the shutter curtain 3 as approaching a lower end of the surface 16*b*. By forming the fixing hole 16 into such a shape, when the fixing tool 15 is inserted into the fixing hole 16 as shown in FIGS. 5(A) and 5(B), the fixing tool 15 abuts against the surface 16*b* of the fixing hole 16 which is opposite from the shutter curtain 3, the fixing tool 15 is guided and the connecting member 8*a* is pushed against the shutter curtain 3. Since the shutter curtain 3 is pushed against one of side surfaces of the first rail groove 10, the shutter curtain 3 is fixed more strictly. Therefore, the shutter curtain 3 of the reinforcing structure 1 for the slide shutter of this embodiment does not rattle, and even when strong wind blows, a noise is not generated.

Figure 5:
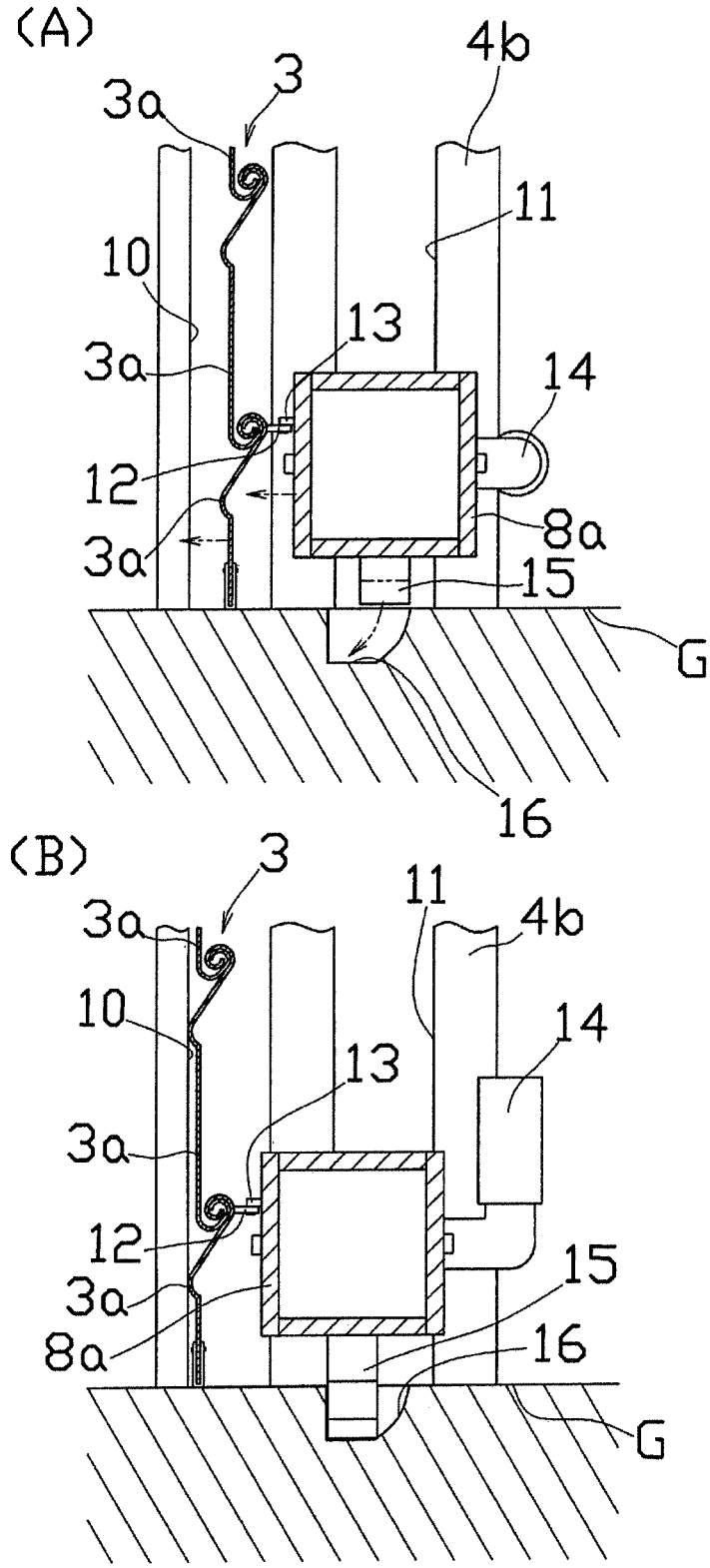
FIG. 5(A) is a partially omitted enlarged sectional view of a shutter curtain and the connecting member as viewed from side in a state where the slide shutter is closed and a hook is fixed to an engaging portion and FIG. 5(B) is a partially omitted enlarged sectional view of the shutter curtain and the connecting member as viewed from side in a state where the fixing tool is inserted into the fixing hole from the state shown in FIG. 5(A).

As shown in FIG. 5, the reversed L-shaped hook 13 formed on the surface of the connecting member 8*a* on the side of the shutter curtain 3 is inserted, from above, into the annular engaging portion 12 provided on the lowermost slat 3*a* and the hook 13 is fixed. According to this, even if attempt is made to pull up the shutter curtain 3 from outside for example, the connecting member 8*a* is caught, and since the connecting member 8*a* is fixed to the installation surface G of the slide shutter 2, the shutter curtain 3 can not be pulled up and the slide shutter 2 is locked in a state where it is closed. Therefore, it is possible to effectively suppress the unauthorized invasion into the building. At that time, the reinforcing base member 6 and the length-adjusting member 7 extend from the upper end of the guide rail 4*a* to the lower end of the guide rail 4*b*, and it is possible to reinforce the shutter curtain 3 against wind from outside of the building.

Figure 6:
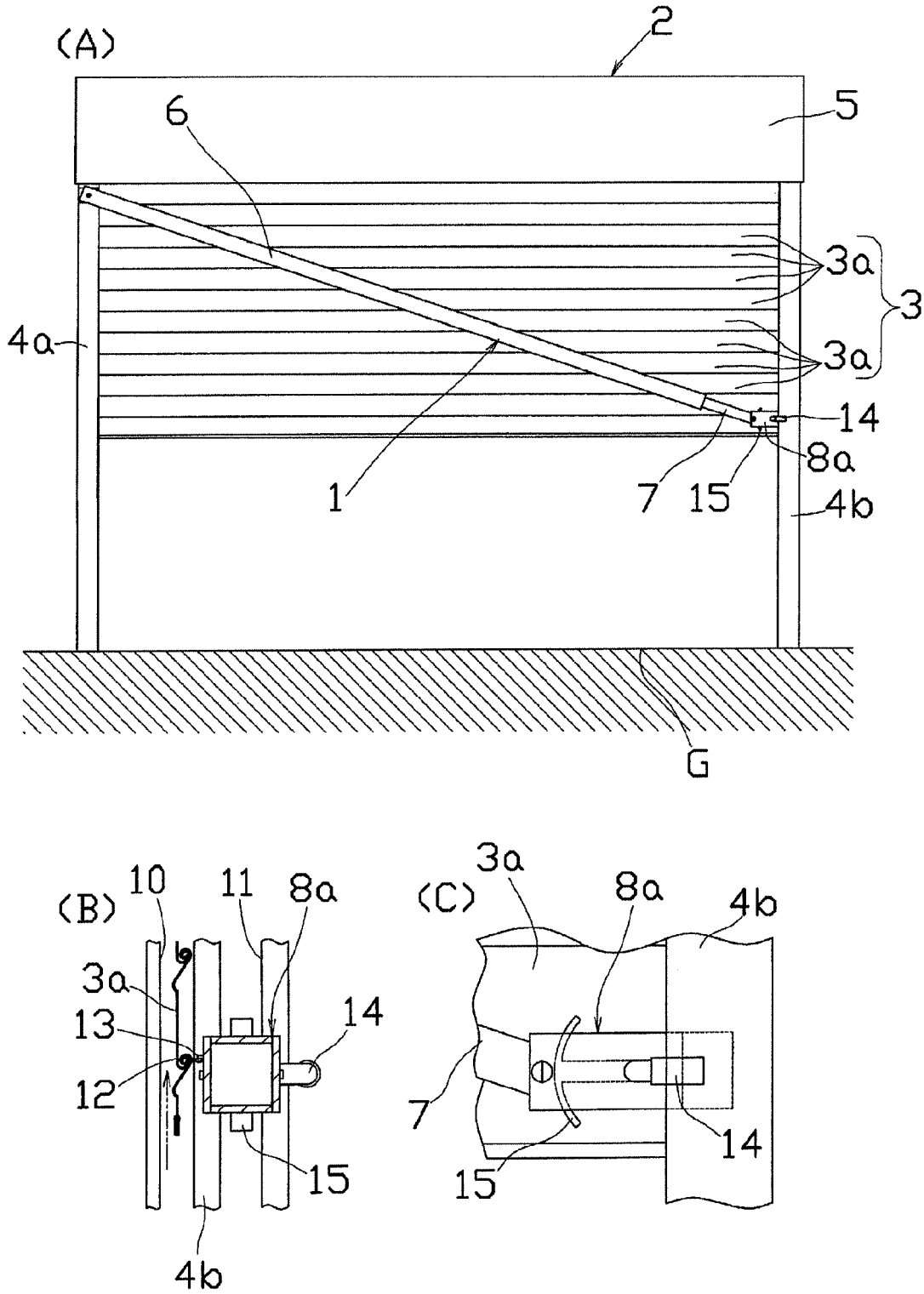
FIG. 6(A) is a front view for explaining a halfway state where the slide shutter is opened.
FIG. 6(B) is a partially omitted enlarged sectional view of the shutter curtain and the connecting member as viewed from side in the halfway state where the slide shutter is opened and FIG. 6(C) is an enlarged front view of the fixing tool as viewed from front in the halfway state where the slide shutter is opened.

When the shutter curtain 3 is pulled up and the building opening is opened, the operating lever 14 is operated and the fixing tool 15 is disengaged from the fixing hole 16 formed in the installation surface G of the slide shutter 2. Then, if the lowermost shutter curtain 3 is pulled up, the roll-up shaft 9 accommodated in the shutter case 5 is rotated by the resilient body and the shutter curtain 3 is rolled up around the roll-up shaft 9. At that time, since the connecting member 8*a* is caught on the lowermost slat 3*a* as shown in FIG. 6, the connecting member 8*a* interlocks with the upward movement of the shutter curtain 3 and slides upward. Since the tip end of the length-adjusting member 7 inserted into the reinforcing base member 6 is rotatably fixed to the connecting member 8*a* as shown in FIG. 6, the length-adjusting member 7 is gradually inserted into the reinforcing base member 6 and rises from one end thereof as the connecting member 8*a* rises.

Figure 7:
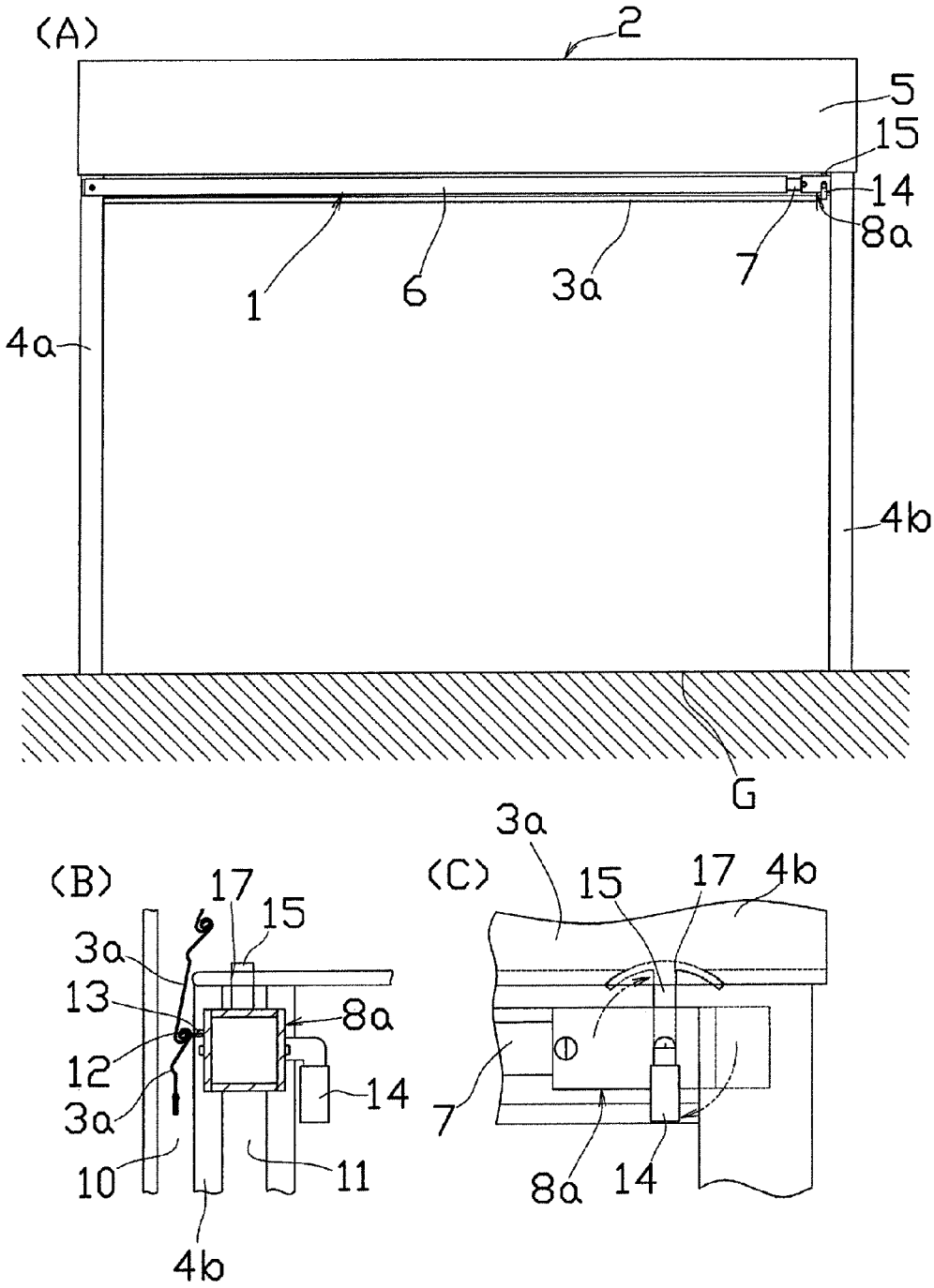
FIG. 7(A) is a front view for explaining a state where the slide shutter is opened.
FIG. 7(B) is a partial enlarged sectional view of a state where the fixing tool is inserted into an engaging hole as viewed from side and FIG. 7(C) is a partial enlarged view of a state after the fixing tool is inserted into the engaging hole as viewed from front.

If the lowermost slat 3*a* is pulled up to the uppermost portions of the guide rails 4*a* and 4*b* as shown in FIG. 7(A), the connecting member 8*a* is also located at the uppermost portion of the guide rail 4*b*, and the reinforcing base member 6 and the length-adjusting member 7 are held in a state where they extend between the upper ends of both the guide rails 4*a* and 4*b*. Then, as shown in FIGS. 7(B) and 7(C), the operating lever 14 is operated to insert the fixing tool 15 of the connecting member 8*a* into an engaging hole 17 formed in the shutter case 5 and fix the fixing tool 15 therein. Since the hook 13 formed on the surface of the connecting member 8*a* on the side of the shutter curtain 3 is engaged with the engaging portion 12 formed on the lowermost slat 3*a*, the reinforcing base member 6 and the length-adjusting member 7 do not come down even if the fixing tool 15 is not fixed to the engaging hole 17 of the shutter case 5, but if the fixing tool 15 is fixed to the engaging hole 17, the reinforcing base member 6 and the length-adjusting member 7 can more reliably be held at the upper ends of both the guide rails 4*a* and 4*b*. According to the reinforcing structure 1 for the slide shutter of the embodiment, the slide shutter 2 can be opened by the same operation as an opening operation of a conventional general slide shutter 100 except that the operating lever 14 is operated at the initial stage and the last stage.

When the shutter curtain 3 is pulled down and the building opening is closed, the operating lever 14 is first operated to disengage the fixing tool 15 which is fixed to the engaging hole 17. Even if the fixing tool 15 is disengaged, since the hook 13 of the connecting member 8*a* is engaged with the engaging portion 12 provided on the lowermost slat 3*a* of the shutter curtain 3, the connecting member 8*a* does not come down, and since the reinforcing base member 6 and the length-adjusting member 7 are held at the upper end of the building opening, there is no danger that the reinforcing base member 6 and the length-adjusting member 7 fall to a head of an operator. Then, the shutter curtain 3 is pulled down using a pull-down rod (not shown).

As a result, the connecting member 8*a* which is engaged with the engaging portion 12 of the lowermost slat 3*a* slides on the second rail groove 11 by its own weight and comes down. Then, the lowermost slat 3*a* is moved down to the lowermost end of the building opening to close the building opening. At that time, the connecting member 8*a* also interlocks with the lowering movement of the shutter curtain 3 and slides downward. After the lowermost slat 3*a* and the connecting member 8*a* are moved down to the lowermost end, the operating lever 14 is operated to insert the fixing tool 15 into the fixing hole 16 and to fix the fixing tool 15 therein. The slide shutter 2 can be closed by the same operation as a closing operation of the conventional general slide shutter 100 except that the operating lever 14 is operated.

According to the reinforcing structure 1 for the slide shutter of the embodiment, the operation for fixing the fixing tool 15 to the fixing hole 16 and the engaging hole 17 may be omitted. In this case, although suppressing effect for the unauthorized invasion into the building is lowered, it is possible to reinforce the shutter curtain 3 against strong wind which blows inward of the building, and it is possible to open and close the slide shutter 2 by the same opening and closing operations of the conventional general slide shutter 100. Therefore, when a user is away from the building at nighttime or away from the building for a long term, the shutter curtain 3 is pulled down, the operating lever 14 is operated to fix the fixing tool 15 to the fixing hole 16 and lock the shutter curtain 3 reliably, but when the user is away from the building for a short time, it is only necessary to pull down the shutter curtain 3 and in this case also, the wind-resistant effect against strong wind can be exerted.

Figure 8:
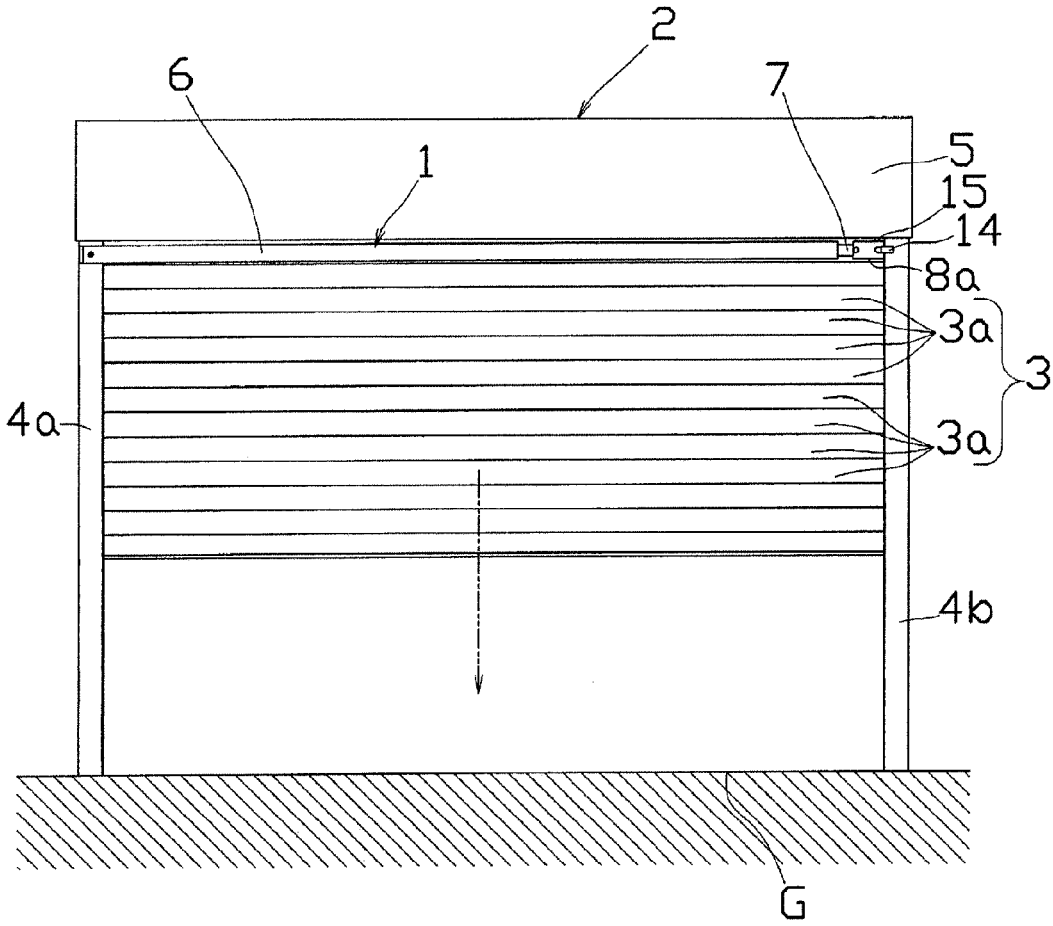
FIG. 8 is a diagram showing a state where the shutter curtain is pulled down while keeping the fixing tool fixed to the engaging hole.

As shown in FIG. 8, according to the reinforcing structure 1 for the slide shutter of the embodiment, the shutter curtain 3 can be pulled down while keeping the fixing tool 15 fixed to the engaging hole 17. In this case, the shutter curtain 3 comes down and slide shutter 2 can be closed but since the connecting member 8*a* is kept fixed to the engaging hole 17, the reinforcing base member 6 and the length-adjusting member 7 are kept held on the upper ends of both the guide rails 4*a* and 4*b*. Therefore, when there is no fear of strong wind and when there is no possibility of unauthorized invasion, if there is no need for reinforcing the shutter curtain 3 using the reinforcing structure 1 for the slide shutter of the embodiment, the reinforcing base member 6 and the length-adjusting member 7 are kept held on the upper ends of both the guide rails 4*a* and 4*b*. According to this, a load applied when the shutter curtain is opened and closed can further be reduced.

Next, a second embodiment of the present invention will be described with reference to FIG. 9. The same configurations as those of the first embodiment will be designated with the same symbols and explanation thereof will be omitted. The reinforcing structure 1 for the slide shutter of the second embodiment can especially preferably be used when a wide slide shutter 2 is reinforced.

Figure 9:
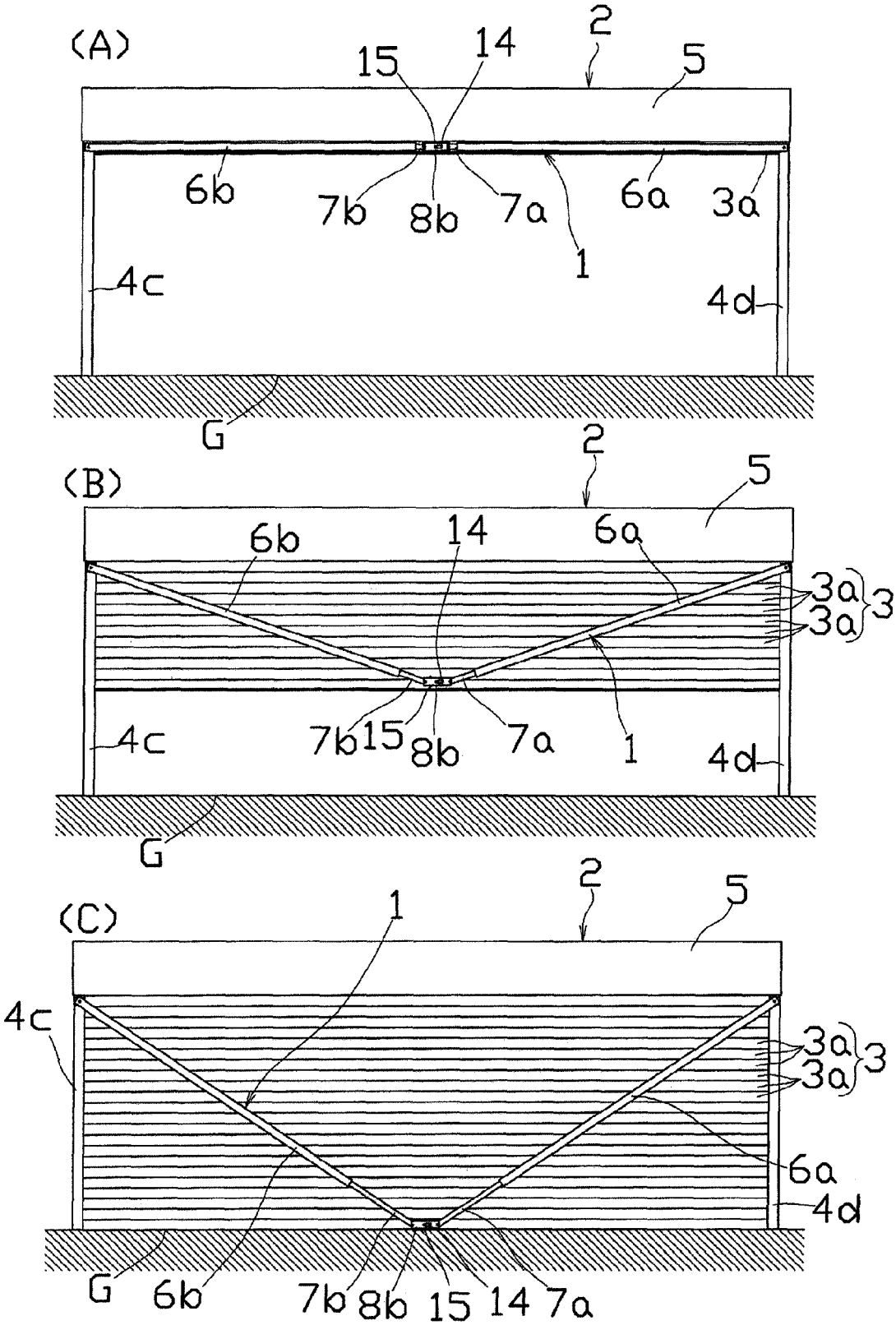
FIG. 9(A) is a diagram showing a reinforcing structure for a slide shutter according to a second embodiment and is a front view for explaining a state where the slide shutter is opened.
FIG. 9(B) is a diagram showing the reinforcing structure for the slide shutter of the second embodiment and is a front view for explaining a halfway state where the slide shutter is opened or closed and FIG. 9(C) is a diagram showing the reinforcing structure for the slide shutter of the second embodiment and is a front view for explaining a state where the slide shutter is closed.
Figure 10:
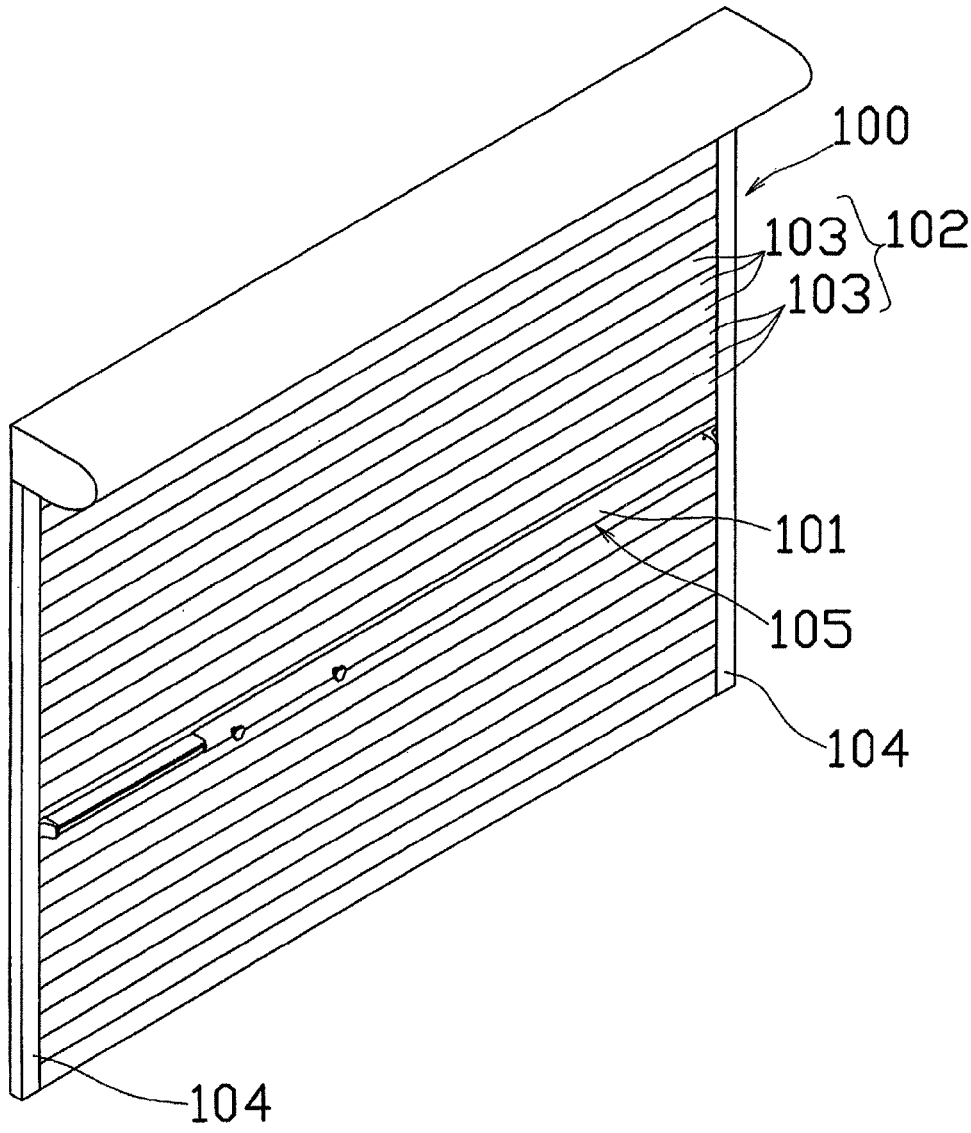
FIG. 10 is a perspective view of a conventional reinforcing structure for a slide shutter.

As shown in FIG. 9, the reinforcing structure 1 for the slide shutter of the second embodiment includes a slide shutter 2. The slide shutter 2 has a shutter curtain 3 formed by interconnecting a plurality of slats 3*a*, a pair of left and right guide rails 4*c* and 4*d* for vertically guiding the shutter curtain 3, and a shutter case 5 which rolls up the shutter curtain 3 at an upper location and accommodates the shutter curtain 3 therein. The reinforcing structure 1 also includes a hollow and long first reinforcing base member 6*a*, one end of the first reinforcing base member 6*a* is turnably mounted on an upper end of the guide rail 4*c* and the other end of the first reinforcing base member 6*a* is opened. The reinforcing structure 1 also includes a first length-adjusting member 7*a* which is inserted into the first reinforcing base member 6*a* such that the first length-adjusting member 7*a* can extend and contract, and a hollow long second reinforcing base member 6*b*. One end of the second reinforcing base member 6*b* is rotatably mounted on an upper end of the other guide rail 4*d* and the other end of the second reinforcing base member 6*b* is opened. The reinforcing structure 1 also includes a second length-adjusting member 7*b* which is inserted into the second reinforcing base member 6*b* such that the second length-adjusting member 7*b* can extend and contract, and a connecting member 8*b* which is movably connected to the first length-adjusting member 7*a* and the second length-adjusting member 7*b*. A first rail groove 10 in which the shutter curtain 3 slides is formed in each of the pair of guide rails 4*c* and 4*d*, but the second rail groove 11 in which the connecting member 8*b* slides is not formed in the guide rails 4*c* and 4*d* unlike the first embodiment.

When the shutter curtain 3 is pulled up to open the building opening, the operating lever 14 of the connecting member 8*b* is operated to insert the fixing tool 15 into the engaging hole 17 formed in a central portion of the shutter case 5 in its width direction and fix the connecting member 8*b*. When the shutter curtain 3 is pulled down to close the building opening, the operating lever 14 of the connecting member 8*b* is operated to insert the fixing tool 15 into the fixing hole 16 formed in a central portion between the pair of guide rails 4*c* and 4*d* of the installation surface G of the slide shutter 2 and fix the connecting member 8*b*.

According to the reinforcing structure 1 for the slide shutter of the second embodiment having the above-described configuration, when the slide shutter 2 is closed, since the first reinforcing base member 6*a* and the second reinforcing base member 6*b* are disposed in a substantially V-shape, it is easy to secure the reinforcing strength as compared with a case where the reinforcing base member is disposed diagonally straightly like the first embodiment. Especially when the slide shutter 2 is closed, if the fixing tool 15 is fixed to the fixing hole 16 formed in the installation surface G of the slide shutter 2, the reinforcing structure is fixed by three points, that is, upper ends of the pair of guide rails 4*c* and 4*d* and the central portion of the installation surface G. Therefore, it is possible to more effectively reinforce the shutter curtain 3.

The embodiments are just examples, the embodiments are not limited to those described above, and the embodiments can appropriately be changed within a range not departing from the idea of the invention.

INDUSTRIAL APPLICABILITY

The reinforcing structure 1 for the slide shutter of the present invention can preferably be used as a structure for reinforcing the slide shutter 2 which is used for opening and closing a building opening.

The invention claimed is:

1. A reinforcing structure for a slide shutter comprising:

a shutter curtain which is formed by connecting a plurality of vertically moving slats with each other, a pair of left and right guide rails for guiding the shutter curtain, a shutter case which is provided above the guide rails and which rolls up the shutter curtain and accommodates the shutter curtain therein, wherein the reinforcing structure includes a hollow long shutter reinforcing base material whose one end is rotatably mounted on an upper end of one of the pair of guide rails and whose other end is opened, a length-adjusting member which is inserted into the shutter reinforcing base material and which can extend therefrom and retract therein, a connecting member, which is rotatably connected to a tip end of the length-adjusting member and which is guided by the other one of the pair of guide rails, and a reversed L-shaped hook which is formed on a surface of the connecting member on a side of the shutter curtain and which is inserted, from above, into an annular engaging portion formed on one of the slats that is located on a lowermost side, and wherein the connecting member includes a fixing tool which can be fixed to a fixing hole formed in an installation surface of the slide shutter and which can be engaged with an engaging hole formed in the shutter case.

2. A reinforcing structure for a slide shutter comprising:

a shutter curtain which is formed by connecting a plurality of vertically moving slats with each other, a pair of left and right guide rails for guiding the shutter curtain, a shutter case which is provided above the guide rails and which rolls up the shutter curtain and accommodates the shutter curtain therein, wherein the reinforcing structure includes a hollow long first reinforcing base material whose one end is rotatably mounted on an upper end of one of the pair of guide rails and whose other end is opened, a long first length-adjusting member which is inserted into the first reinforcing base material and which can extend from the first reinforcing base material and which is retractable therein, a hollow and long second reinforcing base member whose one end is rotatably mounted on an upper end of the other guide rail of the pair of guide rails and whose other end is opened, a long second length-adjusting member which is inserted into the second reinforcing base material and which can extend from and retract into the second reinforcing base material, and a connecting member which rotatably connects a tip end of the first length-adjusting member and a tip end of the second length-adjusting member with each other and which is attachable to and detachable from a lower end of the slat, and wherein the connecting member includes a fixing tool which can be fixed to a fixing hole formed in an installation surface of the slide shutter and which can be engaged with an engaging hole formed in the shutter case.

* * * * *